US006208298B1

(12) United States Patent
Uchino et al.

(10) Patent No.: US 6,208,298 B1
(45) Date of Patent: Mar. 27, 2001

(54) PLANAR ARRAY ANTENNA

(75) Inventors: Shigeru Uchino; Moriyoshi Kawasaki, both of Yokohama (JP)

(73) Assignee: Harada Industry Co., Ltd. (JP)

( * ) Notice: Subject to any disclaimer, the term of this patent is extended or adjusted under 35 U.S.C. 154(b) by 0 days.

(21) Appl. No.: 09/420,114

(22) Filed: Oct. 18, 1999

(30) Foreign Application Priority Data

Oct. 19, 1998 (JP) ..... 10-296792

(51) Int. Cl.[7] ..... H01Q 1/38
(52) U.S. Cl. ..... 343/700 MS
(58) Field of Search ..... 343/700 MS, 829, 343/846, 848, 853; H01Q 1/38

(56) References Cited

U.S. PATENT DOCUMENTS

| | | | | |
|---|---|---|---|---|
| 5,309,164 | * | 5/1994 | Dienes et al. | 343/700 MS |
| 5,572,222 | * | 11/1996 | Mailandt et al. | 343/700 MS |
| 5,892,481 | * | 4/1999 | Andersson | 343/700 MS |
| 5,892,482 | * | 4/1999 | Coleman et al. | 343/700 MS |
| 5,896,107 | * | 4/1999 | Huynh | 343/700 MS |

* cited by examiner

*Primary Examiner*—Tho G. Phan
(74) *Attorney, Agent, or Firm*—Pennie & Edmonds LLP

(57) ABSTRACT

A planar array antenna includes a ground plate formed of metallic material, a plurality of patch antenna elements supported on the ground plate by insulation spacers, respectively, and arrayed at a predetermined pitch, and a feed line for coupling adjacent antenna elements of the plurality of patch antenna elements.

1 Claim, 4 Drawing Sheets

PLANAR ARRAY ANTENNA

BACKGROUND OF THE INVENTION

The present invention relates to a planar array antenna which can be applied to a transmit/receive antenna used for a WLL (wireless local loop) terminal.

FIGS. 5A to 5C illustrate one example of a prior art planar array antenna of the above type. Referring to these figures, a plurality of (two in this example) patch antenna elements 101 and 102 are arrayed on a rectangular dielectric substrate 100. The elements 101 and 102 are coupled to each other by a feed line 103, while the element 102 is coupled to a feeding point 105 by a feed line 104. The feed lines 103 and 104 are each constituted of a strip line adhered onto the dielectric substrate 100.

In the prior art planar array antenna, an electric power is applied, as a series feed, from the feeding point 105 to the patch antenna elements 101 and 102 through the feed lines 103 and 104.

The planar array antenna so constituted is miniaturized as a whole by the dielectric effect of the dielectric substrate 100. Since, however, the antenna is decreased in gain due to a dielectric loss, a usable bandwidth of VSWR (voltage standing-wave ratio) is narrowed. Since, moreover, the plurality of patch antenna elements 101 and 102 are arrayed and an electric power is applied to these elements as a series feed, the following problem arises. The patch antenna elements 101 and 102 are difficult to arrange at the optimum interval under the influence of a so-called contraction rate due to the dielectric of the dielectric substrate 100. This problem will be described more specifically.

As illustrated in FIGS. 5A and 5B, the electrical length of the antenna is determined such that the length of each of the patch antenna elements 101 and 102 and the interval between them are both $\lambda/2$ when the wavelength of transmitted/received wave is $\lambda$. In FIGS. 5A and 5B, it is $\lambda/2$ and $P=\lambda$ that correspond to the electrical length. The contraction rate, which is one of dielectric effects of the dielectric substrate 100, is taken into consideration in order to set the electrical length.

Assuming that Teflon (known under the trade name of du Pont) is employed as the dielectric substrate 100 and its effective permittivity is $\epsilon e$, an actual physical distance R between the patch antenna elements 101 and 102 is given by the following equation:

$$R=\lambda/2(\epsilon e)^{1/2}\approx 0.7\lambda/2$$

If, as shown in FIG. 5C, the energy area of the patch antenna element 101 is S101 and that of the patch antenna element 102 is S102, these areas overlap each other to cause a region S103 shaded diagonally therein. The overlapped region S103 reduces the antenna efficiency and accordingly the maximum gain cannot be obtained under the influence of a dielectric loss. When Teflon is used as the dielectric substrate 100, the gain falls within a range from 8 dBi to 9 dBi, which is about 30% lower than the maximum gain in the ideal status or in air.

If an electric power is applied to the patch antenna elements 101 and 102 as a parallel feed, the foregoing problem does not arise, whereas the following drawback occurs: since the antenna necessitates an allotter, its structure is complicated and increased in size, and a loss is produced from the allotter.

BRIEF SUMMARY OF THE INVENTION

The object of the present invention is to provide a planer array antenna having the following advantages:

(a) Even though an electric power is applied to arrayed patch antenna elements as a series feed, the energy areas of adjacent antenna elements can be prevented from overlapping and the antenna elements can be arrayed at ideal intervals, when the length of each of the elements and the interval therebetween are both set to a predetermined electrical length;

(b) Since the ideal intervals can be secured and no dielectric loss occurs, the antenna efficiency is remarkably improved and the maximum antenna gain can be obtained; and (c) The antenna can be simplified and miniaturized as a whole, and its costs can be lowered greatly.

In order to attain the above object, the planar array antenna of the present invention has the following feature in constitution. The other features will be clarified in the Description of the Invention.

A planar array antenna according to the present invention comprises a ground plate formed of metallic material, a plurality of patch antenna elements supported on the ground plate by insulation spacers, respectively, and arrayed at a predetermined pitch, and a feed line for coupling adjacent antenna elements of the plurality of patch antenna elements.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION (Embodiment)

[Constitution]

Figure 1A:
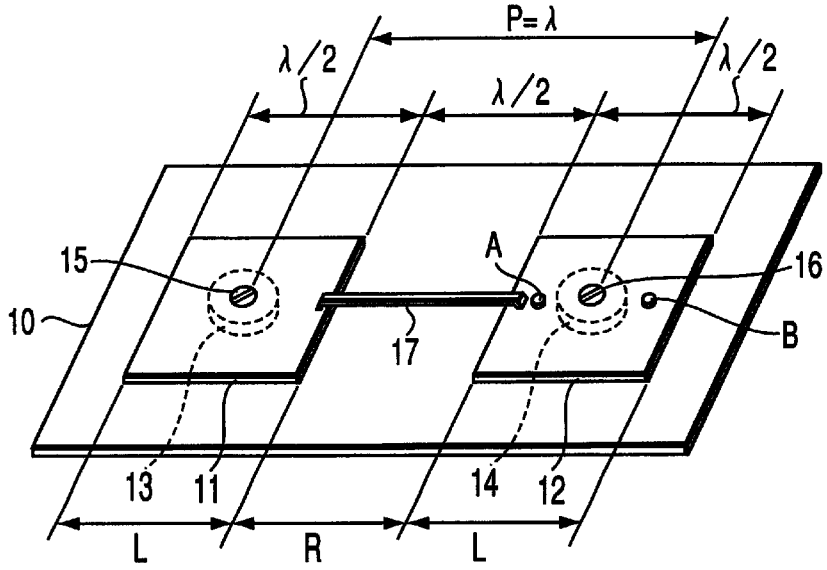
FIG. 1A is a perspective view of the constitution of a planar array antenna according to an embodiment of the present invention.
Figure 1B:
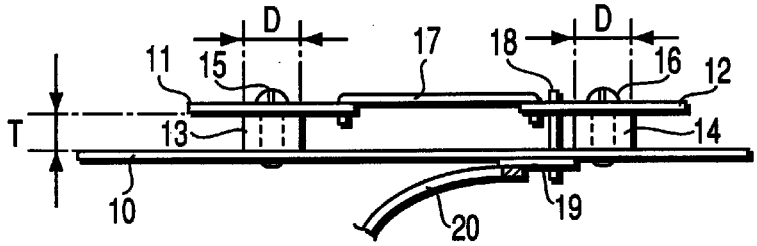
FIG. 1B is a side view of the constitution of the planar array antenna according to the embodiment of the present invention.
Figure 1C:
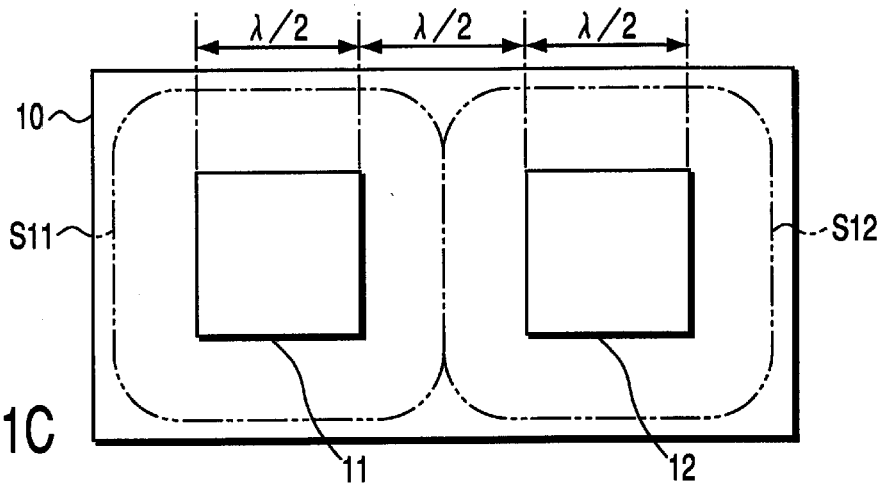
FIG. 1C is an illustration for explaining a function of the planar array antenna according to the embodiment of the present invention.

FIGS. 1A to 1C illustrate a planar array antenna according to an embodiment of the present invention. In FIGS. 1A and 1B, reference numeral 10 denotes a ground plate formed of metallic material such as brass. A plurality of (two in this embodiment) patch antenna elements 11 and 12, which are metal plates formed of the same brass, are supported on the ground plate 10 by means of insulation spacers 13 and 14, respectively. Reference numerals 15 and 16 indicate fixing screws for mounting and fixing the patch antenna elements 11 and 12 onto the ground plate 10.

The insulation spacers 13 and 14 are each a cylinder (short cylinder in this embodiment) formed of resin such as polyacetal, polycarbonate, and ABS. These spacers each have a considerably small diameter D and an appropriate thickness T, with respect to the areas of the patch antenna elements 11 and 12, such that they can locally support the central parts of the elements 11 and 12.

The electrical length is determined such that the length of each of the patch antenna elements 11 and 12 and the interval between them are both $\lambda/2$ when the wavelength of transmitted/received wave is $\lambda$. In other words, the patch antenna elements 11 and 12 each having a length of $\lambda/2$ are arranged in an orderly line at a given interval or with a pitch $P=\lambda$. The elements 11 and 12 are connected to each other by means of a feed line 17 constituted of a strip line whose length is $\lambda/2$ and whose resistance ranges from 100Ω to 500Ω. The strip line can be formed using a brass- or copper-made wire or plate.

To determine the above electrical length, any contraction rate need not be considered in particular since there are no dielectric substrates. Consequently, the length of the feed line 17 or the actual physical distance R between the patch antenna elements 11 and 12 can be set equal to the length L of each of the elements 11 and 12. In other words, both the distance R and length L can be set to $\lambda/2$.

Points A and B are set on the patch antenna element 12. Since the side lobe of directivity is out of balance at the point B, the point A is regarded as a feeding point. As shown in FIG. 1B, a feeding pin 18 stands on the point A, a portion of the pin 18 which projects toward the back of the ground plate 10, is connected to a matching substrate 19 for correcting a reactance, and the matching substrate 19 is connected to a feeder 20.

[Function]

As described above, the patch antenna elements 11 and 12 of the present invention are formed on the ground plate 10 of metallic material and their central parts are locally supported by their respective insulation spacers 13 and 14 of short cylinders. The antenna elements 11 and 12 are coupled to each other by means of the feed line 17 of the wire or plate strip line such that the line acts as a bridge in the air. The length of each of the elements 11 and 12 is $\lambda/2$, and they are arrayed at a predetermined interval (with a pitch $P=\lambda$).

Consequently, the dielectric-loss elements of the planar array antenna are only the ultrasmall-sized insulation spacers 13 and 14 supporting the patch antenna elements 11 and 12. In the embodiment of the present invention, therefore, the permittivity is $\epsilon r$ related to the antenna gain becomes "1" which is close to that in air, with the result that the dielectric loss is very low and the gain is hardly decreased.

Since no dielectric is present between the two patch antenna elements 11 and 12, the physical distance R between them is not influenced by the contraction rate due to a dielectric and, in other words, the distance R can be set to a length corresponding to $\lambda/2$.

Even though an electric power is applied to the arrayed patch antenna elements 11 and 12 as a series feed, the energy areas S11 and S12 of adjacent elements 11 and 12 can be prevented from overlapping when the element length and the element interval are set to the electrical length of $\lambda/2$ as illustrated in FIG. 1C. In other words, the ideal array interval can be secured, so that the antenna efficiency is remarkably increased and the maximum antenna gain can be achieved.

In the present invention, the gain of the two patch antenna elements 11 and 12, which was conventionally 8 dBi to 9 dBi, can be increased up to 12 dBi or higher. If the number of patch antenna elements having the same structure is increased, the gain can be improved further. A usable bandwidth of VSWR can be broadened greatly.

Figure 2:
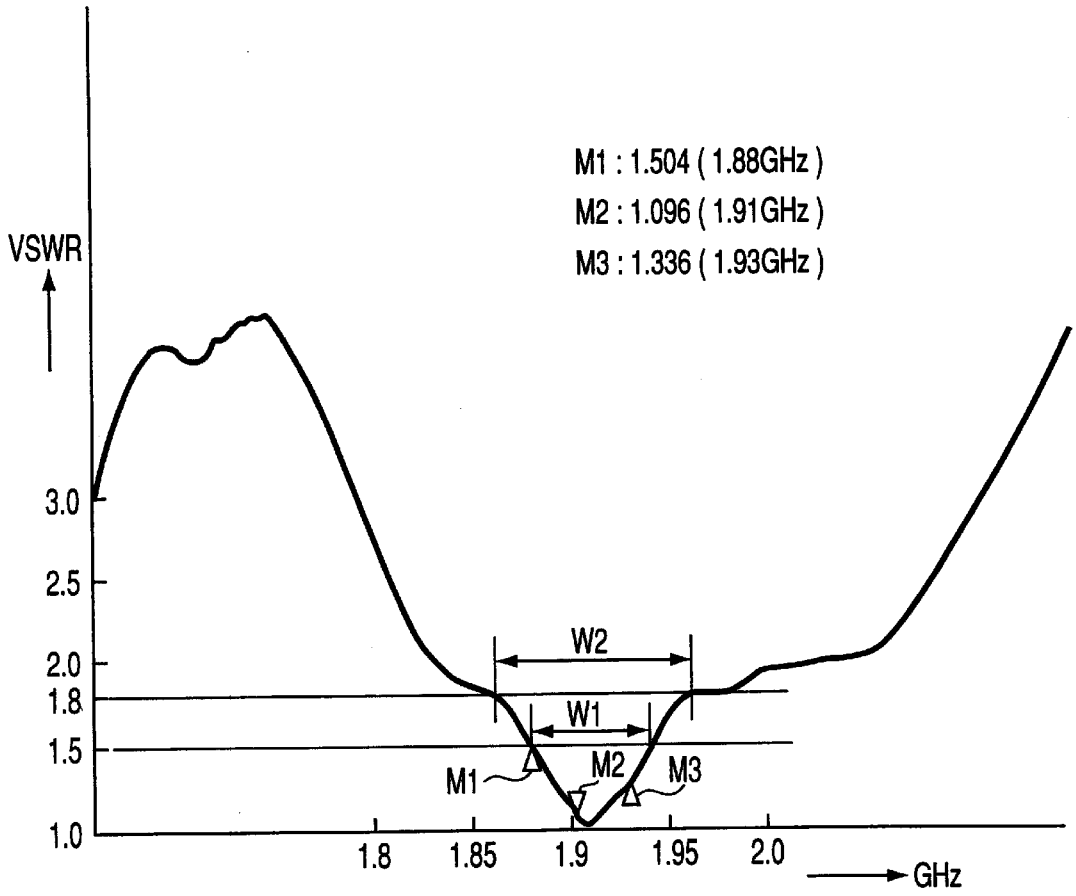
FIG. 2 is a graph showing VSWR characteristics of the planar array antenna according to the embodiment of the present invention.

FIG. 2 is a graph showing VSWR characteristics of the planar array antenna according to the embodiment of the present invention. As is apparent from FIG. 2, the bandwidth W1, which was conventionally 1.5%, is improved to 2.9% when VSWR is 1.5 or less, while the bandwidth W2, which was conventionally 2.8%, is improved to 5.3% when VSWR is 1.8 or less.

Figure 3:
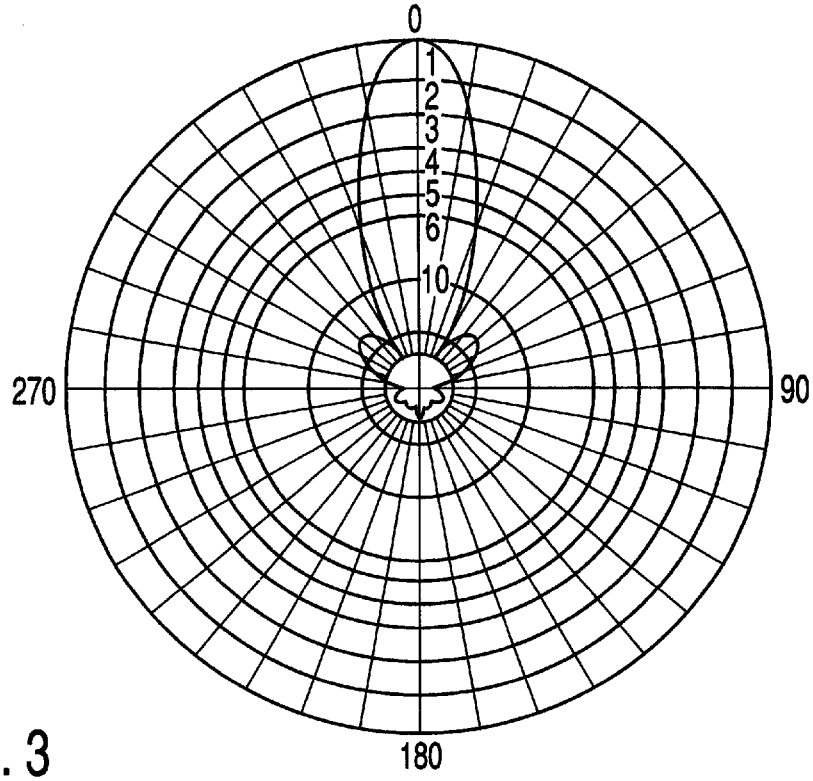
FIG. 3 is a radiation-pattern view of the directivity of E-plane of the planar array antenna according to the embodiment of the present invention.
Figure 4:
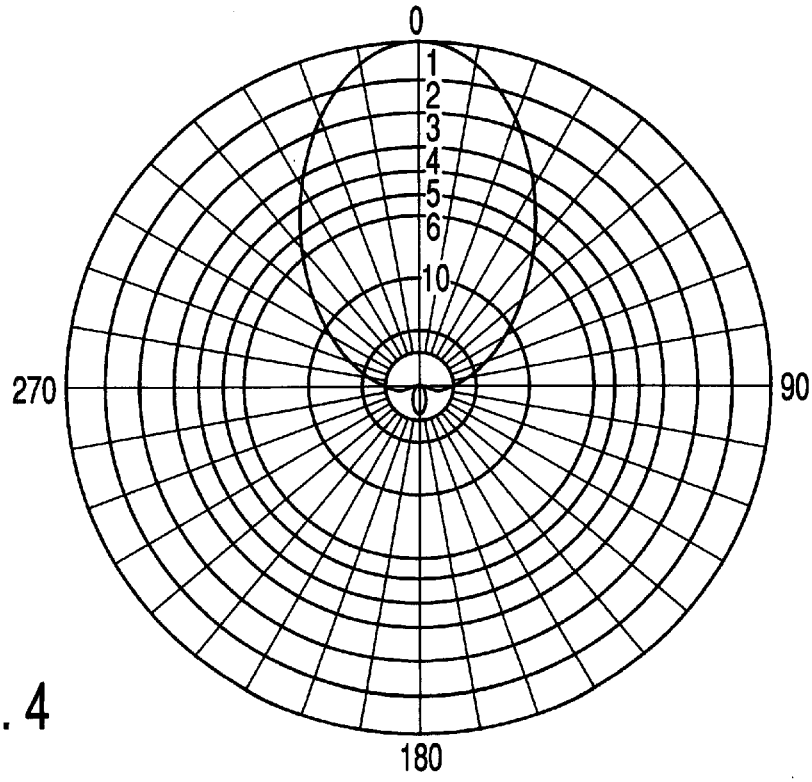
FIG. 4 is a radiation-pattern view showing the directivity of H-plane of the planar array antenna according to the embodiment of the present invention.
Figure 5A:
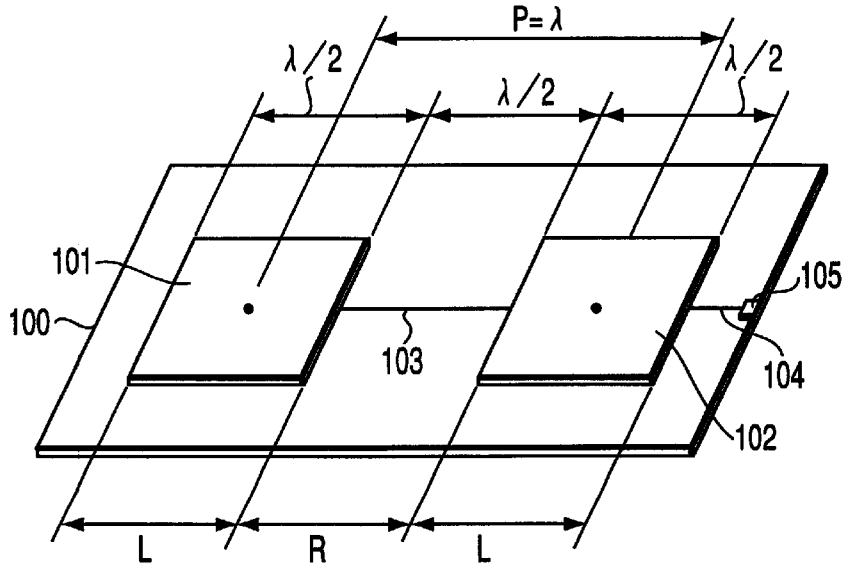
FIG. 5A (PRIOR ART)
FIG. 5A is a perspective view of the constitution of a prior art planar array antenna.
Figure 5B:
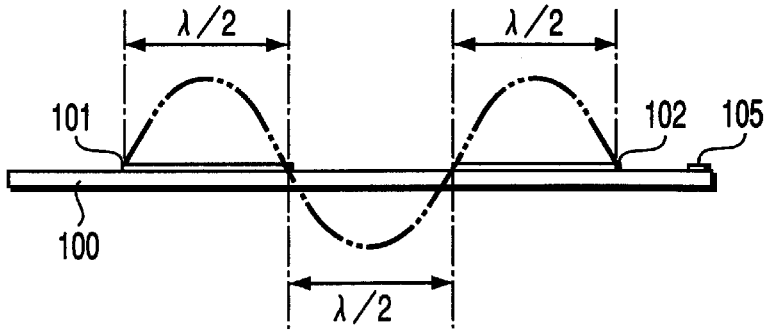
FIG. 5B (PRIOR ART)
FIG. 5B is a side view of the constitution of the prior art planar array antenna.
Figure 5C:
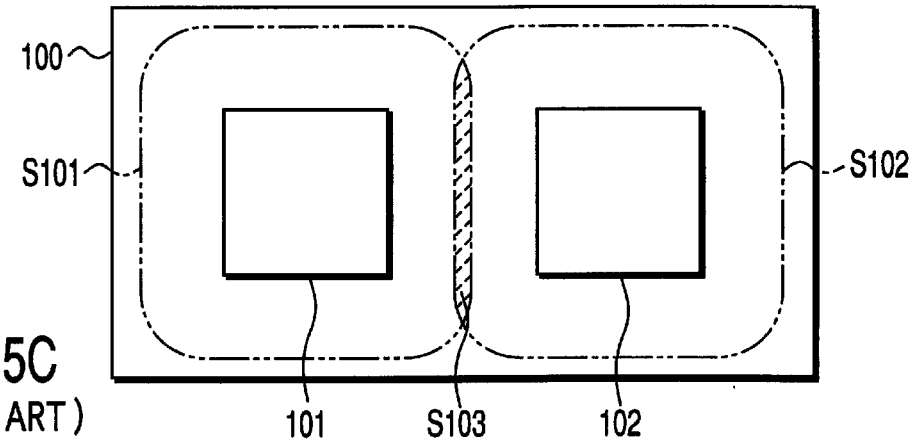
FIG. 5C (PRIOR ART)
FIG. 5C is an illustration for explaining a problem of the prior art planar array antenna.

FIG. 3 is a radiation-pattern view (beam width: 27.75 degrees) of the directivity of E-plane (electric-field plane) of the planar array antenna according to the embodiment of the present invention, while FIG. 4 is a radiation-pattern view (beam width: 61.50 degrees) of the directivity of H-plane (magnetic-field plane) of the planar array antenna. As illustrated in FIGS. 3 and 4, the directivity of both the E and H planes have good characteristics which are sufficiently in practical use.

The planar array antenna of the embodiment of the present invention can be simplified and miniaturized as a whole. Since, furthermore, the ground plate 10 of metallic material is used as a base, the materials cost of the antenna becomes 10% to 20% lower than that of a conventional one using a dielectric substrate as a base. The antenna of the present invention can thus be manufactured at very low cost.

(Features of the Embodiment)

[1] A planar array antenna according to the above embodiment, comprises:

a ground plate (10) constituted of metallic material;

a plurality of patch antenna elements (11, 12) supported on the ground plate (10) by insulation spacers (13, 14), respectively, and arrayed at a predetermined pitch (P); and a feed line (17) for coupling adjacent antenna elements of the plurality of patch antenna elements (11, 12).

[2] In the planar array antenna described in the above item [1], the insulation spacers (13, 14) are cylinders for locally supporting part of each of the patch antenna elements (11, 12).

[3] In the planar array antenna described in the above item [1], when a wavelength of transmitted/received wave is $\lambda$, a length of each of the patch antenna elements (11, 12) is set to $\lambda/2$, and the patch antenna elements (11, 12) are arrayed at a pitch of $\lambda$.

[4] In the planar array antenna described in the above item [2], when a wavelength of transmitted/received wave is $\lambda$, a length of each of the patch antenna elements (11, 12) is set to $\lambda/2$, and the patch antenna elements (11, 12) are arrayed at a pitch of $\lambda$.

[5] In the planar array antenna described in the above item [1], the feed line (17) is a strip line extending like a bridge to couple the patch antenna elements (11, 12) to each other.

[6] In the planar array antenna described in the above item [2], the feed line (17) is a strip line extending like a bridge to couple the patch antenna elements (11, 12) to each other.

[7] In the planar array antenna described in the above item [3], the feed line (17) is a strip line extending like a bridge to couple the patch antenna elements (11, 12) to each other.

[8] In the planar array antenna described in the above item [4], the feed line (17) is a strip line extending like a bridge to couple the patch antenna elements (11, 12) to each other.

[9] The planar array antenna according to the embodiment includes the above items [1] to [8] in combination.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A planar array antenna comprising:

a ground plate formed of metallic material;

a plurality of patch antenna elements, each of said elements having a central part locally supported on the ground plate by a single insulation spacer formed of a cylinder; and a feed line extending between and coupling two patch antenna elements, wherein when a wavelength of transmitted/received wave is $\lambda$, a length of each of the plurality of patch antenna elements is set to $\lambda/2$, and the patch antenna elements are arrayed at a pitch of $\lambda$.

* * * * *